United States Patent [19]

Brubakken et al.

[11] Patent Number: 4,704,747

[45] Date of Patent: Nov. 10, 1987

[54] SELF-CONTAINED BATHROOM UNIT

[76] Inventors: Gardner G. Brubakken, 610 Stillwell Ave.; Mehdi Mohammadian, 1143 Cherry St., both of Oshkosh, Wis. 54901

[21] Appl. No.: 874,062

[22] Filed: Jun. 13, 1986

[51] Int. Cl.[4] ..... E03D 1/00

[52] U.S. Cl. ..... 4/321

[58] Field of Search ..... 4/321-323, 4/347

[56] References Cited

U.S. PATENT DOCUMENTS 1,556,565 10/1925 Walsh .

3,067,433 12/1962 Dietz et al. ..... 4/321 X 3,582,995 6/1971 Enenstein ..... 4/321 X 4,377,875 3/1983 Brubakken ..... 4/321 X 4,485,500 12/1984 Melville ..... 4/228

*Primary Examiner*—Charles E. Phillips

*Attorney, Agent, or Firm*—Paul L. Sjoquist

[57] ABSTRACT

Self-contained bathroom unit including a rigid L-shaped tank enclosure and the toilet attached thereto, the enclosure having a downwardly inclined lower surface and an upwardly raised top surface, the enclosure additionally having a sewage pump positioned in a collection sump area, the bathroom unit additionally having connections for water inlets, sewage outlets, vents and attachments for other appliances.

4 Claims, 4 Drawing Figures

SELF-CONTAINED BATHROOM UNIT

BACKGROUND OF THE INVENTION

The present invention relates to self-contained bathroom units, and particularly to bathroom units which may be conveniently installed in either new or preexisting building structures, at or above floor level, and above or below sewage drain facilities.

Self-contained bathroom facilities are particularly useful in home remodeling where a bathroom facility is desired in a location not conducive to the installation of the typical bathroom components. An example of a prefabricated self-contained bathroom facility is U.S. Pat. No. 3,582,995, granted to Enenstein on June 8, 1971. This patent discloses a prefabricated toilet and vanity assembly attached to a rigid baselike structure which forms a shallow storage area for sewage and wastewater. U.S. Pat. No. 4,377,875, owned by the assignee of the present invention, discloses a self-contained bathroom unit wherein an L-shaped storage area is used for temporary storage of waste materials. Additionally, this patent discloses the placement of the toilet fixture on the vertical wall of the unit and utilizes a float mechanism to activate the sewage pump.

The need for such structures may be as a result of special construction requirements as in the remodeling of cabins, special economic considerations as in prefabricated bathrooms, or considerations of the environment and available external facilities, as in the case of bathrooms positioned below the grade level of existing sewer facilities. Depending upon these and other particular considerations, one or more structural forms may be better adaptable as a solution to particular problems. In meeting the varying requirements of any particular situation it is desirable to provide not only a bathroom unit which may be adapted to the varying requirements, but also one that may be completely functional and aesthetically attractive, and one which may be adapted to the particular decorating and structural limitations at the location where the unit is to be installed.

SUMMARY OF THE INVENTION

The present invention provides a completely adaptable self-contained bathroom unit for many of the applications in special considerations described herein. A generally L-shaped and rigid fiberglass tank forms the functional and structural base for a self-contained bathroom unit. The tank includes a large reservoir for the storage of sewage and waste liquids, and houses the sewage pump and plumbing lines for water, sewage collection and disposal, and venting. The interior of the horizontal portion of the tank is inclined downwardly toward a sump area located at the back of the bathroom unit. Additionally, the tank provides a support base for attachment of other bathroom fixtures as well as providing a collection tank for waste material from these fixtures.

The self-contained unit described herein may be installed in preexisting structures by merely setting it on floor level, or preferably by recessing it partially into the floor, and in either event the height of all of the bathroom fixtures forming a part of the unit or attached thereto may be readily adjusted to the normal height acceptable for such fixtures. Further, once installed, the self-contained bathroom unit may be easily incorporated into the decorating scheme preferred for the room in which it is installed.

It is therefore a principal object of the present invention to provide a self-contained bathroom unit for installation in new or preexisting structures to accommodate any structural limitation which may exist.

Another object of the present invention is to provide a self-contained bathroom unit in which the height of all bathroom fixtures may be made conventional for fixtures of the type disclosed.

Another object of the present invention is to provide a self-contained bathroom unit which has a relatively small collection sump and will provide for nearly complete removal of the sewage present in the tank.

As yet another object of the present invention is to provide a self-contained bathroom unit which may be amenable to the decorating scheme for the room in which it is installed.

BRIEF DESCRIPTION OF THE DRAWINGS

Preferred embodiment of the invention is described herein, and with reference to the drawings, in which.

DESCRIPTION OF THE PREFERRED EMBODIMENT

Figure 1:
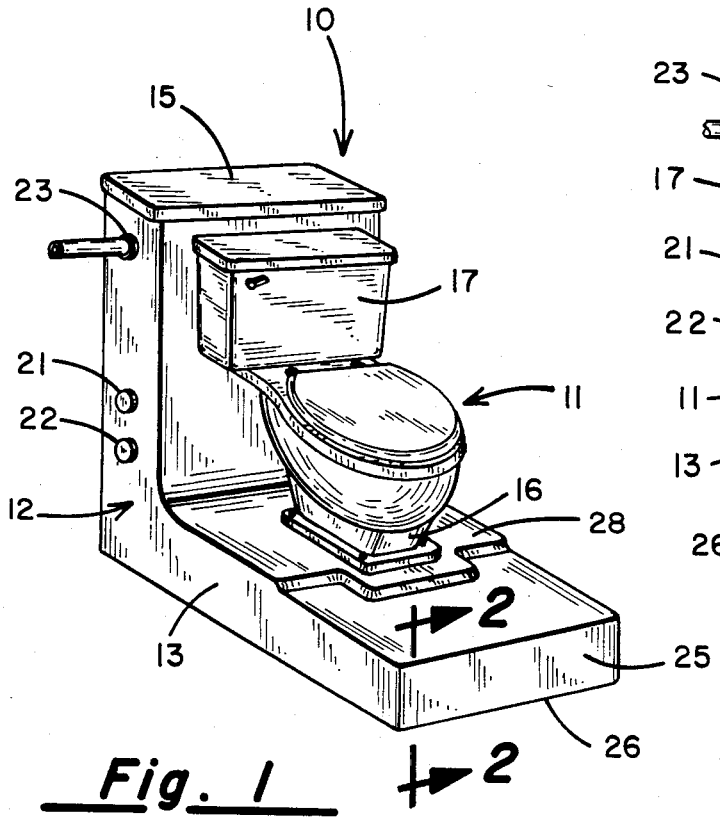
FIG. 1 is an isometric view of the invention.
Figure 3:
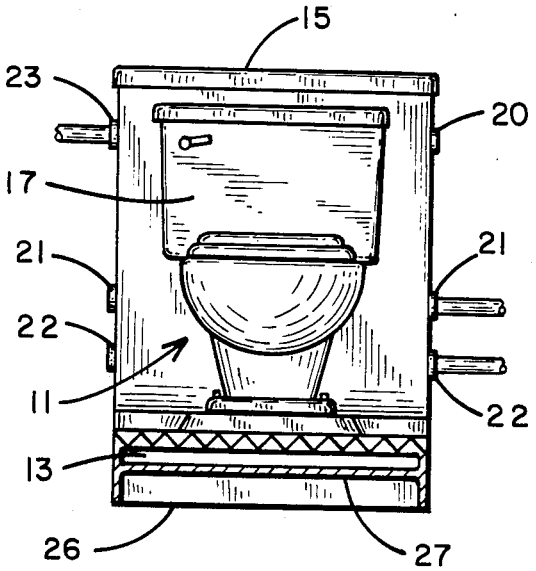
FIG. 3 is a partial cross-sectional view taken along lines 3—3 of FIG. 2.
Figure 4:
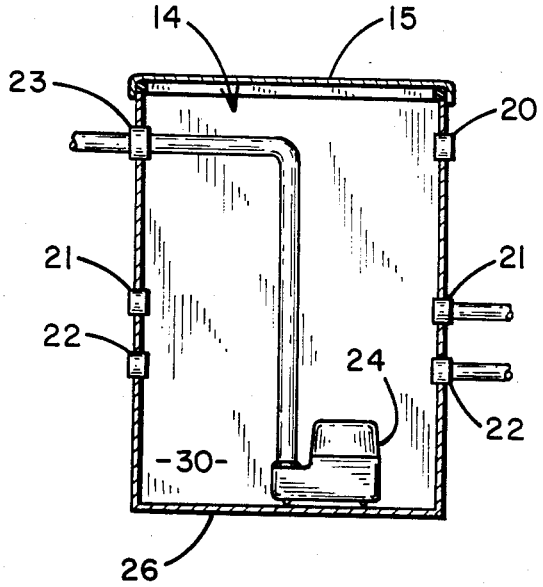
FIG. 4 is a cross-sectional view of the invention taken along lines 4—4 of FIG. 2.
Figure 2:
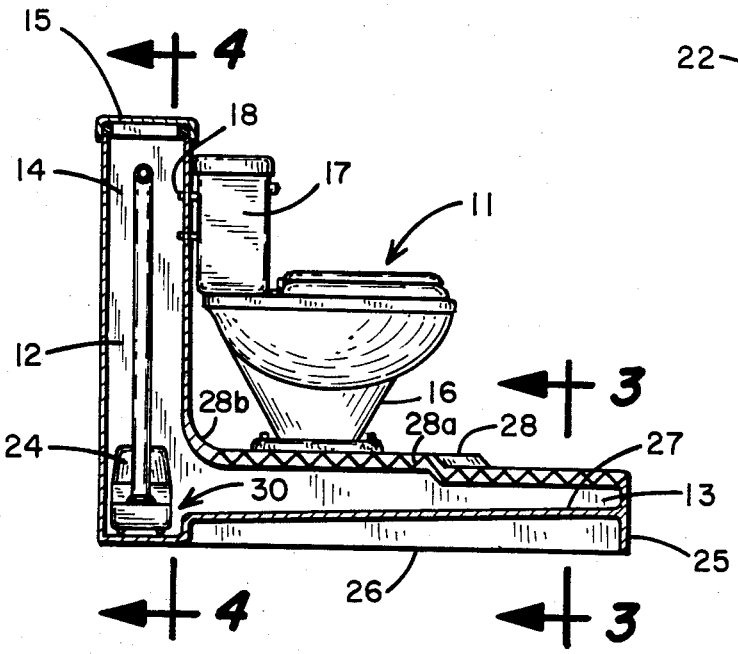
FIG. 2 is a cross-sectional view of the invention taken along lines 2—2 of FIG. 1.

One form of this invention is illustrated by the drawings and is described herein. The bathroom unit is preferably constructed of a non-corrosive material such as fiberglass and is indicated generally as 10. The bathroom unit 10 consists of a standard size toilet fixture 11 and an L-shaped tank structure 12 having a rectangular horizontal reservoir area 13 and a vertical compartment 14. The vertical compartment 14 contains a top opening to provide easy access into the tank area. A cover 15 is sealably fitted over the top opening and is preferably fitted with a gasket to provide an airtight seal with the top of vertical compartment 14.

The toilet fixture 11 is preferably affixed at its base 16 to the horizontal reservoir area, as shown. The water tank 17 is seated on toilet fixture 11 in the conventional manner.

The vertical compartment 14 of the bathroom unit 10 includes openings on its sidewalls for connection to a vent pipe 20, a water inlet 21, a wastewater inlet 21 and 22, and a sewage outlet 23. The bottom of the vertical compartment 14 is recessed below the horizontal reservoir 13 to provide a collection sump 30 for the waste matter. A sewage pump 24 is located in this sump 30 and is connected to the sewage outlet 23. The sewage pump 24 contains an actuating means near its base to activate the sewage pump 24 whenever waste matter accumulates in sump 30 to a predetermined depth. Sewage pump 24 is a commercially available submersible pump, such as Model 267 available from Zoeller Co., Louisville, Ky.

The horizontal reservoir 13 contains a front panel 25, lower support edges 26, an inclined inner bottom surface 27, and a raised top support surface 28. The front panel 25 prevents accumulation of debris under the horizontal reservoir 13 by preventing accumulation of debris between the support edges 26. The support edges 26 aid in the positioning of the bathroom unit 10 by eliminating the need for a completely flat floor surface. The inclined inner bottom surface 27 is inclined downwardly towards the collection sump 30 to prevent excess accumulation of wastewater in the horizontal reservoir area 13. The raised top support surface 28 provides support for the toilet fixture 11 and promotes the flow of gases from the horizontal reservoir 13 to the vent pipe 20 in the vertical compartment 14.

The raised top support surface 28 is particularly formed to add strength and rigidity to the support surface, and to prevent sewage gases from becoming entrapped inside of the horizontal reservoir area 13. Support surface 28 may include a special honeycomb area 28*a* which adds rigidity to the floor surface, and surface 28 is preferably formed into a stepped-up area for further strength and rigidity. The rear proportion of support surface 28 is formed into a rounded curve 28*b* to merge into the front wall of vertical compartment 14. Curved portion 28*b* serves to further strengthen the structural relationship between vertical compartment 14 and the horizontal section including compartment 13. Further, curved portion 28*b* provides an inner curved section to facilitate the escape of sewage gases from entrapment within horizontal compartment 13. This combination of structural features provides a uniquely rigid floor surface for supporting the wide range of weights which the system may encounter in operation.

The self-contained bathroom unit may be constucted of fiberglass material, and support surface 28 may be additionally constructed of a honeycomb structure enclosed or embedded in fiberglass outer coverings. The curved portion 28*b*, joining the vertical and horizontal extensions, provides a strengthening junction which is particularly when useful when the unit is constructed of fiberglass.

In operation, the bathroom unit 10 may be installed by merely resting it on a floor surface, or the unit may be recessed into a floor so that the top surface of support surface 28 is flush with the floor. After the bathroom unit 10 has been positioned in a preferred location in a room, the water and sewage pipes are connected to the appropriate tank connections. A vent pipe may be added to provide an external vent for the bathroom unit 10. The electrical connections necessary to operate the sewage pump 24 may be obtained by merely plugging a cord (not shown) into a nearby wall outlet.

In use, when the toilet is flushed or when wastewater enters the bathroom unit 10, the bottom of the horizontal reservoir 13 gradually becomes filled with liquids and sewage materials. The downward incline of the bottom surface 27 promotes the accumulation of the waste material in the collection sump 30. The sewage pump 24 has an inlet in the collection summp 30, and may be actuated when the waste material reaches a predetermined level or manually whenever it is convenient to empty the reservoir 13. The shut-off level for the sewage pump 24 is preferably below the height of the nearest edge of the bottom surface 27 to provide for optimal removal of the waste material from the unit. Additionally, the horizontal reservoir 13 should be large enough to hold forty or more gallons of waste material so that the material may be collected over a period of time before it is necessary to actuate the sewage pump 24.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A self-contained bathroom unit, comprising (a) a generally L-shaped enclosure having a hollowed interior, comprising a horizontal extension and a vertical extension, and an open top end in said vertical extension, (b) a cover removably and sealably fitting over said open top end of said vertical extension;

(c) said horizontal extension having top side and bottom surfaces enclosing a reservoir area;

(d) said bottom surface of the horizontal extension having downwardly projecting support edges;

(e) the interior of said horizontal extension having said bottom surface inclined downwardly toward said vertical extension, said horizontal extension directing flow of waste by gravity to a collection sump formed at the interecting region of said horizontal and vertical extensions, said collection sump having a lower surface recessed below the lowest point of said horizontal extension bottom surface to promote the accumulation of waste material in said collection sump for subsequent removal of the waste material from said collection sump;

(f) a sewage pumping means located in said collection sump, said sewage pumping means having an actuating means lower than the lowest end of the bottom surface of the horizontal extension to actuate said pump when waste is present; and (g) said top surface of said horizontal extension having a raised interior surface portion extending toward said vertical extension and including a curved radius at the juncture of said horizontal and vertical extensions, thereby providing a raised interior sewage gas collection region in said horizontal extension which opens into said vertical extension and facilitates the escape of sewage gases from entrapment within said horizontal extension, (h) said raised interior surface portion creating a stepped exterior of said top surface, and a commode mounted on said stepped exterior above said raised interior surface portion.

2. The bathroom unit of claim 1, wherein a toilet fixture is in flow communicating relation with the top of the horizontal extension and is affixed thereto by a fixture support means.

3. The bathroom unit of claim 1, wherein the L-shaped enclosure is constructed of fiberglass.

4. The bathroom unit of claim 1, wherein said horizontal extension includes a vertical front panel perpendicularly attached to said side extensions.

* * * * *